US005429564A

United States Patent [19]

Doane

[11] Patent Number: 5,429,564

[45] Date of Patent: Jul. 4, 1995

[54] EXERCISING APPARATUS

[76] Inventor: Michael P. Doane, 1434 Cola Dr., McLean, Va. 22101

[21] Appl. No.: 145,544

[22] Filed: Nov. 4, 1993

Related U.S. Application Data

[63] Continuation-in-part of Ser. No. 998,195, Dec. 29, 1992, abandoned.

[51] Int. Cl.[6] ..... A63B 21/008

[52] U.S. Cl. ..... 482/56; 434/254

[58] Field of Search ..... 434/254; 482/56, 111, 482/112

[56] References Cited

U.S. PATENT DOCUMENTS

| | | | |
|---|---|---|---|
| 2,109,775 | 3/1938 | Hudson | 434/254 X |
| 3,791,646 | 2/1974 | Marchignoni | 434/254 X |
| 4,537,396 | 8/1985 | Hooper . | |
| 4,674,740 | 6/1987 | Iams et al. | 5/62 X |
| 4,830,363 | 5/1989 | Kennedy | 434/254 X |
| 4,844,450 | 7/1989 | Rodgers, Jr. | 434/254 X |
| 4,872,668 | 10/1989 | McGillis et al. | 434/254 X |
| 5,029,848 | 7/1991 | Sleamaker . | |
| 5,158,513 | 10/1992 | Reeves | 434/254 X |

FOREIGN PATENT DOCUMENTS

| | | | |
|---|---|---|---|
| 2038826 | 9/1992 | Canada | 482/56 |
| 1523154 | 11/1989 | U.S.S.R. . | |
| 1567228 | 5/1990 | U.S.S.R. | 434/254 |
| 1600814 | 10/1990 | U.S.S.R. | 482/56 |
| 1646560 | 7/1991 | U.S.S.R. | 482/56 |

*Primary Examiner*—Robert P. Swiatek
*Attorney, Agent, or Firm*—Morgan & Finnegan

[57] ABSTRACT

An exercising, e.g., waterless swim training apparatus having a frame and a support for the trainee's torso. The torso support is movable along a curve that is convex to the ground below, thus simulating the rocking, or rolling motion experienced in swimming. The frame and body support may be arranged to provide an obstruction free region so that the user can practice breast stroke, butterfly, back stroke and free style strokes without touching any part of the frame, ground, etc. with his/her fingers. The obstruction free zone is roughly a circular hemi-cylinder, extending below the trainee's body. A resistance mechanism is provided to resist motion of the user's hands. The resistance mechanism presents a force versus velocity relationship that simulates the force versus velocity relationship experienced during swimming. One embodiment uses a piston in a fluid filled chamber, such as air, as the resistance mechanism. Over the velocities involved in swimming, such a mechanism simulates the feel of swimming. For the velocities involved in using the swim trainer, the force is approximately proportional to a power of the velocity between two and three.

18 Claims, 7 Drawing Sheets

EXERCISING APPARATUS

RELATED APPLICATIONS

The above-identified application is a continuation-in-part of prior application Ser. No. 07/998,195, filed Dec. 29, 1992, the entire contents of which are incorporated herein by reference.

FIELD OF THE INVENTION

The present invention relates generally to the field of exercising apparatus for athletic activity, and more specifically to a waterless swimming trainer. The exercising apparatus can be used to improve strength and technique.

BACKGROUND AND THEORY OF THE INVENTION

Learning to swim and training to become a better swimmer are both facilitated by the trainee or swimmer practicing exercises and repetitive routines. The exercises help to refine the motions that the swimmer should use to swim efficiently. Some exercises also strengthen the muscles that are used in making the swimming motions.

It is well known that weight training, or weight lifting can improve a swimmer's performance due to the increased strength resulting from the weight training. There are many forms of weight training. The trainee can use free weights of various weights, shapes and sizes, and can move them about according to many different patterns. The trainee can also use weight training machines, which generally provide a specific staging devoted to development of a particular muscle or muscle group. The staging forces the user to apply muscular force against a resistance and to move his/her limbs through a specific path. The resistance can be provided by stacks of weights engaged by pulleys. The resistance can also be provided by pneumatic cylinders, or by cams connected to large inertial masses. Typically, the user can quickly adjust the amount of weight, or pneumatic resistance, so that the user can change the weight he/she is using, or so that the machine can be used by many different users of different strengths, or following different exercise regimens.

It is also well known that an athlete's muscles develop in a way that is desirable for practice of a particular sport or motion by the actual practice of that sport or motion. Thus, the muscles that a sprinter needs develop by virtue of sprinting. The muscles that a swimmer needs develop by virtue of swimming. It has also been known that the athlete's muscles grow larger, or develop more quickly, if they are applied to overcome a resistance that is greater than that typically encountered by the actual sport, if the resistance is applied in a way that simulates the motions that the athlete should use when actually performing the sport. Thus, the prevalence of stationary bicycles, rowing machines and cross-country ski simulators.

Known devices, referred to as "swim benches," attempt to simulate the swimming action with a resistance for weight training. In the most rudimentary design, the swim bench includes a bench or platform on which the swimmer lies, and handles or paddles attached by cable to weights that move up and down as the swimmer completes and returns each stroke. Although such a device exercises the muscles used in swimming, the dynamic forces required to lift a weight against gravity do not simulate the dynamic forces exerted on the hands and body while swimming. Thus, the rudimentary swim bench does not accurately simulate swimming. It does not feel like swimming to the user. An additional drawback of using this sort of a weight resistance is that there is not damping to slow the weight down at the end of the stroke. Thus, the user must slow hand motion down at the end of the stroke to keep the weight from flying out of control. In swimming, as explained below, it is desirable to accelerate at the end of the stroke, rather than slowing down.

In order to explain the operation of known devices, and point out their drawbacks, it is necessary to present the inventor's theory of the dynamics of swimming. This theory is the inventor's own, and its development is considered to be part of the invention.

Very little research has been conducted regarding the dynamics of the swimming stroke. However, several factors have been identified by experienced swimmers. For instance, a higher resistance to hand motion arises in response to higher hand velocities. Further, at high swimming speeds, the forward speed immediately decreases if the stroke slows. It is also important to note that, to swim quickly, an experienced swimmer accelerates the hand at the end of the stroke. Thus, this sort of hand motion should be permitted. That is, for instance, there should not be any artificial impediment which increases the resistance to the hand at the end of the stroke simply by virtue of the position of the hand. Another impediment to this acceleration at the end of the stroke is a weight that has been previously accelerated by the user, and that must be slowed down at the end of the stroke.

The inventor believes that the foregoing swimmers' experiences can be provisionally formalized as follows. The torso and legs can be modeled like the hull of a ship. The dynamics of the hand and body motion are shown schematically in FIGS. 6*a*, 6*b* and 7. FIG. 6*a* shows schematically a swimmer 600 swimming through the water in three positions: beginning (600*b* in bold line), middle (600*m*, in normal line) and end of a stroke (600*e*, in dotted line) with the right arm, similarly designated 602*b*, 602*m* and 602*e*. (For clarity, the swimmer's left arm is not shown.)

In an ideal situation, a swimmer would cast an arm 602 forward, plant it in the water, and then pull the body 600 through the water, past the hand, and beyond, just as if a bar were fixed in the water and the swimmer were pulling himself through the water by grasping the bar. However, this situation does not exist in water, since there is no bar and water can not be grasped firmly. Some of the water moves backward in response to force applied to it, and further, some of the water leaks around the swimmer's hand and through the swimmer's fingers.

If there were a bar, the swimmer's hand would be stationary with respect to the bar (and the pool foundation) during the catch portion of a stroke, as the body moved forward. The hand would not move forward until the return portion of the stroke brings it out of the water and around. In reality, however, the hand moves backward a small amount during the course of the stroke. This is indicated by the three hand positions 604*b* (beginning of stroke), 604*m* (middle of stroke) and 604*e* (end of stroke). Thus, relative to the pool foundation, during the course of a single stroke, the swimmer's torso moves forward a distance t, while the hand moves backward a distance h. The better the swimmer, the smaller the distance h. Further, the quicker the stroke, the smaller the distance h. For a competent swimmer, swimming moderately fast, h is on the order of six inches (15 cm) and t is on the order of four to five feet (1.5 m), depending on the swimmer's height.

FIG. 7 shows the local environment around the swimmer's body 700 during a stroke. The body is being pulled and forced through the water by the swimmer's hand and arm. The water flows around the swimmer's body. (Relative to the body, if considered stationary, the water flows in the direction indicated by streamlines W. Relative to the stationary pool foundation, the water is virtually stationary and the body moves in the direction of the dotted arrow B.) Like any object in a fluid flow, the water presents a viscous force against the relative motion of the body. Since the water is virtually stationary with respect to the pool foundation, the relative velocity is essentially equal to the velocity of the swimmer's body to the pool foundation.

An additional force also opposes the motion of the body. This force is known as a "pressure drag" which arises due to the fact that turbulence is generated downstream of the body (i.e., at location 708), thereby causing a pressure differential between the upstream end 706 of the body 700 and the downstream end 708, tending to push the body 704 in the direction from high pressure to low pressure, i.e. in the direction the fluid is flowing relative to the body. This is opposite to the direction that the swimmer's body is moving, relative to a stationary pool foundation.

The inventor believes that both the viscous and the pressure drag forces are proportional to the cube of the relative velocity between the fluid and the body.

For a body moving through a fluid, the foregoing fluid dynamics result in a component of the force on the swimmer's body according to the following formula:

$$F=K*V_{body}^3$$

where K is a constant related to each swimmer's body shape.

The swimmer's hand also experiences the same sorts of viscous and pressure drags, however they are applied to the hand in the opposite direction from which they are applied to the body, since the relative motion between the hand and the water is opposite to that of the body and the water.

The force set forth above is the force that the swimmer must apply to his body to move the body at the speed $V_{body}$. Ignoring the swimmer's kick, all of this force must be applied by virtue of interaction between the swimmer's arms, hands and the water. Thus, the force applied by the water to the swimmer's hands and arms is also proportional to the cube of the velocity of the swimmer's body.

The inventor believes that, while the foregoing theoretical explanation is apt, other factors may contribute to the forces experienced by the hands and arms moving through the water such that the force applied by the water is proportional to the velocity of the body raised to a factor greater than two and less than or equal to three. This belief is supported by subjective experiments, comparing the feel of different types of swim benches to actual swimming.

With some types of swim benches, including the type of the present invention, the swimmer's body is stationary relative to the ground, and the swimmer's arms move against a resistance. This is analogous to the situation during actual swimming, as viewed from the position of the swimmer's body. It seems that the body remains stationary as a stream of water flows from the swimmer's head to his feet, with the swimmer's hands moving past the swimmer's body at approximately the speed of the water. This situation is shown schematically in FIG. 6b. The swimmer's body, 600, remains stationary, while three arm positions, beginning (**604*b*), middle (604*m*) and end (604*e***) are shown respectively. The total distance the swimmer's hand moves relative to the body is equal to the distance t the torso would move forward in the water relative to the pool foundation, minus the distance that the swimmer's hand moves relative to the swimmer (h), for a total distance of t–h. Thus, during the same time, the swimmer's body moves a distance t through the water, while the stationary trainee's hand moves a distance t–h in the opposite direction through the air. As has been mentioned, for better, more efficient swimmers, the slippage distance, h, is approximately equal to zero.

Thus, for a trainee using a swimming bench, the speed of the hand is approximately equal to the speed the swimmer's body would be moving through water. As mentioned above, the inventor believes that the force experienced by a swimmer's hand while moving the body through the water includes a component that is proportional to the cube of the velocity of the body (or proportional to a power of the velocity of the body greater than two and less than or equal to three). Since the velocity of the hand through the air is approximately equal to the velocity of the body through the water, it follows that if a force is applied to the hand that includes a component that is approximately proportional to the cube of its velocity through the air (or a power of the velocity greater than two and less than or equal to three) for the velocities in question, that force will simulate the force that the hand actually feels when moving the body through the water. It will feel to the trainee as if he is moving his hand against water in the act of swimming.

Other swim benches have been proposed and used, differing from the rudimentary design mentioned above (lifting a weight against gravity), principally in the resistance mechanism. One resistance mechanism is a spinning inertial mass connected to the cables. As the hand paddles are accelerated, the forces on the hand increase proportionally to the angular acceleration of the mass. The force to increase a velocity of the hand pulling the paddles, is equal to the inertial mass, times the angular acceleration of the mass (which is directly proportional to the translational acceleration of the paddles). Once the disk is spinning fast enough, the swimmer can stroke quickly from the start and accelerate through the finish of the stroke, as is desired for a fast swim.

A drawback of the inertial mass as the resistive element, is that there is no way to adjust the resistance, so it is difficult to accommodate multiple users having strengths spread over a wide range. Further, it is possible to cause the disk to spin so fast, that the arms must move faster than is reasonably possible in the water to keep up with the disk. Consequently, it becomes more difficult to accelerate the arm through each stroke, thus detracting from the accuracy with which the apparatus simulates swimming. Most importantly, the spinning inertia does not present a resistance that feels at all like swimming.

Another proposed resistance mechanism is commonly used, and is similar to stretching a large rubber band or rubber tubing. This mechanism has the advantage that it is simple to implement. The tubing is attached to the handles upon which the swimmer pulls. The resistance force applied to the hand is equal to the spring constant of the tubing times the distance the tubing is stretched from its rest position. Consequently, to move the same distance, the greatest force is applied to the hand at the finish of the stroke. The initial tension can be adjusted, for instance by pre-stretching the rubber element.

A major drawback with this spring resistance apparatus is that it provides no simulation of the relation between force and the cube of hand velocity believed to exist in swimming. Thus, it does not feel like swimming. Typically, the spring constant of a rubber band-like tubing decreases at higher velocities, thus lowering the force required to cause a further extension. However, in swimming, the force at higher velocities increases.

Another form of known apparatus is an inclined monorail with a sliding bench. Such an apparatus is sold by Vasa Inc., of Williston, Vt. under the trade name "Vasa Swim Trainer." The swimmer lies on a bench and pulls on a pair of handles at the ends of a pair of inextendible cables or tethers. The handles do not move longitudinally with respect to the monorail, but they can move transverse of the monorail axis, essentially swinging in an arc with a radius that is the length of the tether. As the user applies force to the handles, the bench slides longitudinally along the monorail toward the handles. The user's body passes his/her hands, which move outward. Resistance is applied due to the incline of the bench, which is variable, and tension (apparently a spring). After each stroke, the swimmer relaxes and the tension and gravity pulls the bench back to the beginning of the monorail. The monorail is typically about eight feet long.

This system suffers from some of the drawbacks mentioned above in that it does not simulate the dynamic forces of swimming believed to be related to the cube of hand velocity. Consequently, it does not feel like swimming. Further, for strokes where each hand moves forward individually, such as the free-style, the body must move backward on the monorail before the opposite hand can be pulled. This jerky motion is far from that which is felt during swimming. Further, it is difficult to accelerate the hand at the end of the stroke, because at that phase of the stroke, the force applied by the tension in the spring is near its greatest, since it is near its fullest extension. The restrained hand motion also minimizes the verisimilitude the apparatus can offer. It is important to have the hand pass near to the body, not far from it. In most strokes, the swimmer must bring his hand either under, or to some extent, across his body. The Vasa trainer monorail prohibits passing the hand underneath the swimmer's body, particularly ahead of the body. Thus, this type of swim trainer does not exercise the muscles actually used in swimming.

U.S. Pat. No. 5,029,848 issued to Sleamaker on Jul. 9, 1991, discloses a monorail device that is similar to the Vasa trainer.

Another known apparatus is described in U.S. Pat. No. 4,830,363, issued to Kennedy on May 16, 1989, which discloses an apparatus having a frame supporting a bench on which the user's torso is supported generally horizontally. Handles are provided attached to retractable cords and mounted on the frame. A tensioning means is provided to retract the cords, but its dynamic specifications are not noted. The bench has a vertically adjustable middle section, so that a bend of the user's body at the waist can be accommodated.

U.S. Pat. No. 3,791,646, issued to Marchignoni on Feb. 12, 1974, discloses an apparatus having a box support on which the user lies, and two triangularly shaped arm units. The box and triangular units house a geared mechanism that provides a resistance. The arms pull on levers that are attached to an anchor that is constrained to travel according to an elliptical path. The device includes an electric motor, which drives the anchors around the elliptical paths, as well as stirrups for the legs.

An additional drawback of all of the known devices is that none accommodate the rocking or rolling motion that is attendant to swimming motions using alternate hand motion, such as the free-style and backstroke. Typically, in such a stroke, as the swimmer finishes each stroke, the body rolls downward toward the side where the arm is pulling through the water. During the execution of these strokes it is critical that the hips remain stationary while the torso is rolled towards that side of the body where the arm is pulling through the water. It is well known that the hips should remain as close as possible to the horizontal position to maintain proper body orientation for the most efficient swimming strokes. In order to effectively simulate this smooth rolling motion with a machine the chest should be cradled in a device which allows an independent rolling motion of the torso while keeping the hips fixed in a horizontal position.

U.S. Pat. No. 4,674,740 issued to Iams et al. on Jun. 23, 1987, discloses a swimming trainer which allows for a rocking motion of the body during execution of the stroke. The drawback of this machine is that the entire body rocks because the entire frame moves as one. It is commonly recognized in the swimming world that the upper and lower body must move independently of each other to properly simulate swimming.

U.S. Pat. No. 5,158,513 issued to Reeves on Oct. 27, 1992, reveals a swimming training apparatus in which the user's body is supported in a generally horizontal position so the user can pull against hand paddles which activate a resistance mechanism. The unique thing about the apparatus is that it allows for independent rotation of a head support, the chest support, and the hip support. It appears that this meets the objectives of the inventor's design. The inventor believes that Reeves' apparatus would be very awkward to use because it does not cradle the user's chest. Furthermore the apparatus which allows for chest rotation forces the chest out of line with the head because its center of rotation is below the body. Using proper stroke technique the body should rotate about a center axis which is approximately in line with the spine of the body. Thus Reeves' apparatus does not simulate the rocking motion of swimming in the way the inventor believes is critical to proper body orientation.

SUMMARY OF THE INVENTION

In accordance with one aspect of the invention, an apparatus is provided to enable dry land swimming training that simulates the dynamic forces applied to a swimmer's hands while swimming naturally. The dynamic forces are applied to the hand by driving a pump with the movement of the hands/paddles. The pump draws water or other hydraulic liquids from a reservoir and then forces it through an adjustable valve and back into the reservoir. The force versus hand velocity relationship of this resistance device very closely matches the inventors theory of the forces involved during swimming.

In accordance with another object of the invention, a waterless swim training apparatus is provided. The device includes a longitudinally extending base support member with a longitudinal axis and a cantilevered support frame having a lower end fixed to a first end of the base support member with an upward and longitudinally extending free end. A first body support has an upper surface receiving the hip portion of a trainee and is horizontally fixed to the support frame and extends upwardly therefrom. The first body support has a rear end spaced inwardly from a fixed end of the support frame and a first end of the support member. The device also includes a second body support having an upper surface that is substantially concave in shape and conforms to the shape of a torso of a trainee. The second body support is separate from and longitudinally spaced from the first body support and closer to the free end of the support frame. The second body support is mounted on the support frame for limited rotation about the support frame and is inclined upwardly relative to a plane defined by the first body support and the base support member. The training device also includes hand grasping features, e.g., handles, paddles, grips, etc., that are connected a second end of the base support member. Fluidic resistance means, e.g., water, oil, etc., cooperate with the hand grasping means. The fluidic resistance means can include a rotary driven fluid displacement pump with adjustable valves with a fluid filled reservoir.

A further object of the present invention is to enable swimming training while permitting the user to move his/her hands along the paths that are appropriate for good form and exercise of the muscles used in swimming, such as a stroke where the hands come under or across the hips at the finish of the stroke. Therefore the body should be supported by a single cantilevered beam secured to the base behind the hips of the user.

Another object of the present invention is to enable dry-land swim training that simulates the natural side-to-side rolling motion of the torso that the swimmer experiences when applying a stroke using alternate hands sequentially. This rotational motion is about a center axis approximately in line with the spine. The rocking motion of the chest support must be independent of the rest of the frame to allow the hips to maintain a horizontal position during the rocking motion of the chest.

Another object of the invention is to cradle the chest with foam padding to keep the body from rolling off the machine during the rocking motion.

Yet another object of the invention is to permit the user of a swim trainer to adjust the resistance to a stroke while positioned on the apparatus.

Another object of the invention is to provide an adjustable fluidic resistance system, e.g., containing hydraulic fluid, that provides for a low resistance cycle, such that a pump associated with the fluidic reservoir can be deactivated when the hand grippers, paddles, etc., are brought from a position behind a trainee's hips forward to a resting position of the training apparatus.

The ultimate object of the invention is to provide a dry land swimming trainer that is of a sturdy and simple construction and can be manufactured in a stylistic design.

FIG. *6a* is a schematic diagram showing the relative position of a swimmer's body and hand through the pulling portion of a swimming stroke.

FIG. *6b* is a schematic diagram showing the relative position of a trainee's body and hand through the pulling portion of a training stroke on a device where the body remains stationary and the hands pull against resistance handles.

Figure 7:
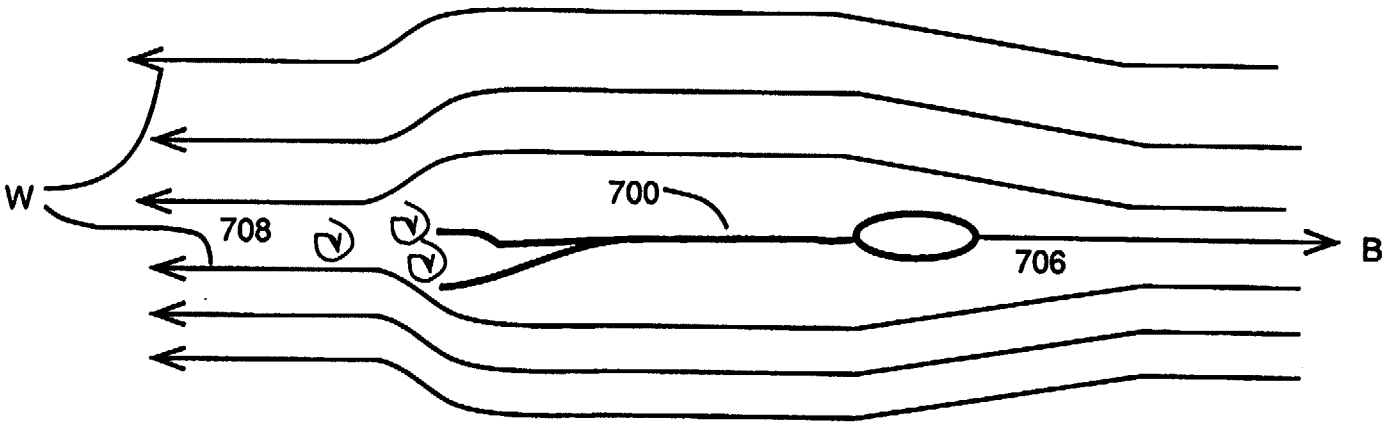

FIG. 7 is a schematic diagram showing a swimmer's body moving through water during a swimming stroke.

DETAILED DESCRIPTION OF THE INVENTION

In a preferred embodiment of the present invention a waterless swim training apparatus having a frame and a support for the trainee's torso is provided. The torso support is movable along a curve that is convex to the ground below, thus simulating the rocking, or rolling motion experienced in swimming.

In another preferred embodiment of the invention, the frame and body support of a swim training apparatus are arranged to provide an obstruction free region so that the user can practice breast stroke, butterfly, back stroke and free style strokes without touching any part of the frame, ground, etc. with his/her fingers. The obstruction free zone is roughly a circular hemicylinder, extending below the trainee's body.

In yet another preferred embodiment, a resistance mechanism is provided to resist motion of the user's hands. The resistance mechanism presents a force versus velocity relationship that simulates the force versus velocity relationship experienced during swimming. The resistance mechanism includes a pair of cables which drive a water or other hydraulic fluid displacement pump through the use of a one way clutch in the drivetrain. The fluid is drawn from a reservoir connected to the machine, through the pump and then forced through an adjustable flow valve. The valve orifice can be made smaller or larger to adjust the resistance of the mechanism. Over the hand velocities involved in swimming, such a mechanism simulates the feel of swimming. Thus, the present invention accomplishes its objects, including facilitating waterless swim training that actually feels like swimming, and properly exercises the muscles involved in swimming.

The preferred embodiments will be discussed with references to the drawings. The invention is shown schematically in a side elevation view in FIG. 1. A base 20 supports rear body support frame 29 and forward pulley support frame 28. The base 20 can be one piece, or two or more pieces, joined by fasteners. Using more than one piece facilitates disassembly and transport or storage of the apparatus. Similarly, the frame pieces can be separate, or can be part of a large, massive frame/-base combination.

Rear frame 10 supports torso support 14 and hip support 21. Collectively, frame 29, torso support-/rocker 22 and hip support 21 may be referred to as a body support. The torso support/rocker is sloped upward from the horizontal hip support at an angle between about 5 degrees and about 10 degrees and preferably not less than 5 degrees or greater than 10 degrees. Rear frame 29 can be fabricated from a single piece of tubular metal. Using a single piece cantilever to support the body from the rear results in high stresses where the frame 29 is secured to the machine base 20. To relieve this stress extra support may be welded in place to strengthen it further.

These frame support stiffeners should be small enough that they never interfere with the hands of a user during the execution of a stroke. The hip support 21 is fixed to frame 29. The torso support 22 is slidable along a curved track that is convex toward the ground and base 20. The means by which this slidability is facilitated is discussed below, with reference to FIGS. 2 and 3.

Figure 1:
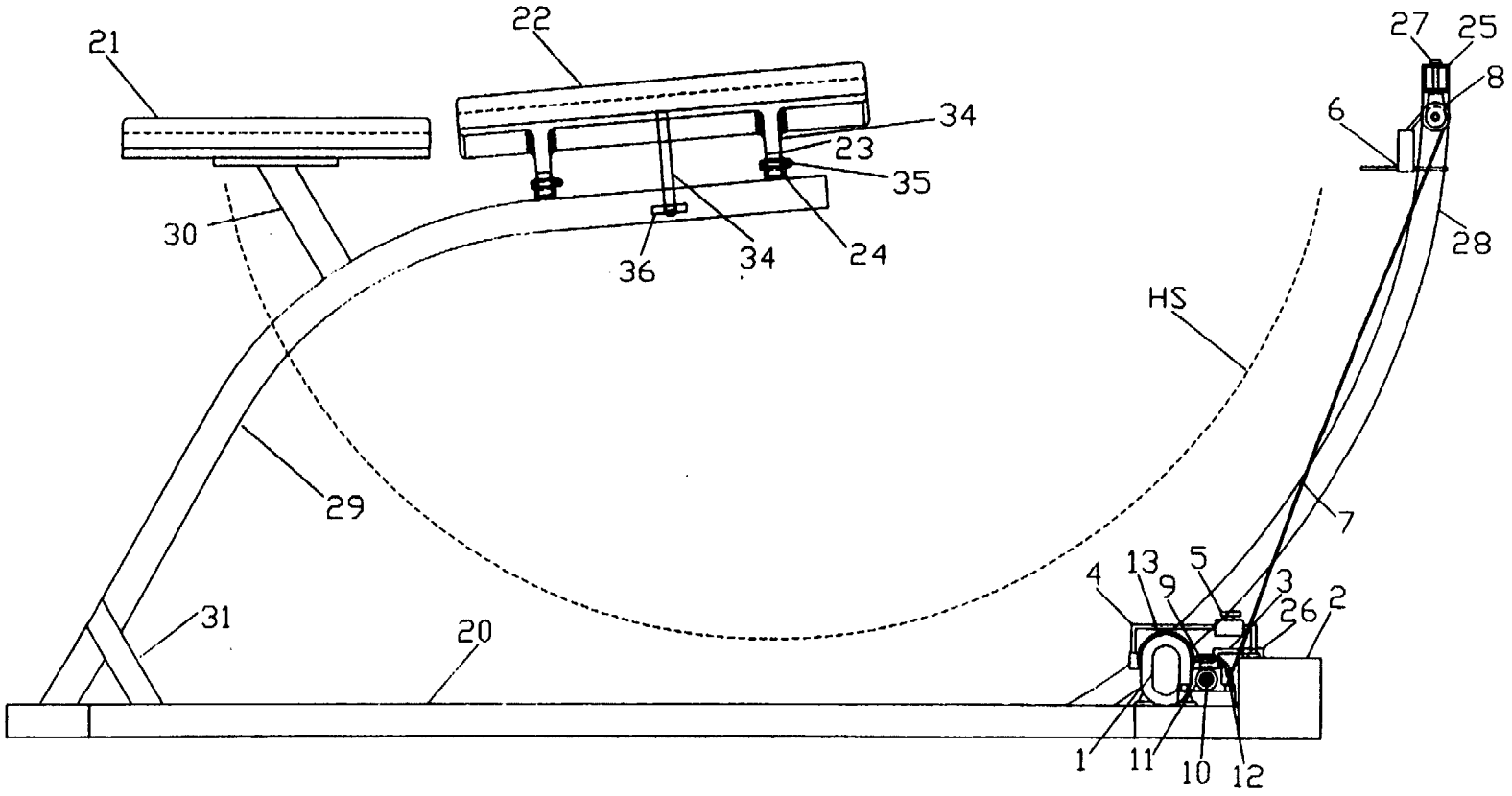
FIG. 1 is a schematic side elevation view of a preferred embodiment of the apparatus of the present invention.

The front frame 28 and pulley support 25 carry a pair of pulleys 8 which rotate on shafts 27, each of which train a cable 7, which are terminated with a paddle 6. (Because FIG. 1 is a side elevation, only one of the pair of pulleys 8, cables 7 and paddles 6 is visible.) Cables 7 are threaded mostly parallel with respect to each other, with the exception of the area around the idler pulleys 16 which are secured either underneath or over the machine base 20. Each passes under a drive pulley or sprocket secured to the shaft 10 which rests in the bearings 11, through a hole in the base, over a pulley 15, it is then routed through the idler pulleys 16 and down the center of the machine where it is secured to a long spring which itself is routed around a pulley and then secured to a point near the front of the machine. This serves to return the paddles to their starting position after each stroke. When the paddles 6 are moved backward towards the hips the drive pulleys 9 engage and rotate the shaft 10. A spur gear 12, or other similar rotary power coupling device, rotates with the shaft which causes a second gear 13 to rotate. A one-way clutch 14 is secured between the gear 13 and the pump shaft 10. This one-way clutch may also be secured between shaft 10 and gear 12o This clutch should be mounted so that the pump shaft is forced to rotate when the paddles are moved backward towards the user's hips.

To use the invention, for a free-style stroke, a user rests his/her hips or upper thighs on hip support 21 and torso on torso support/rocker 22. The user's arm-pits and shoulders should be even with the forward edge of torso support/rocker 22 and rear frame 29. The user grasps one paddle 6 with each hand and performs the swimming motion, alternatively pulling one paddle and then the other. Upon pulling on paddle 6, cable 7 engages the drive pulleys 9 which drive the pump shaft and a resistance to motion of the paddles is developed. The user pulls until maximum extension is achieved. The user then releases pressure on the paddle 6 to which pressure had been applied, and repeats the procedure, pulling on the other paddle 6 with the other arm. As pressure is released on the first paddle, a return mechanism (discussed below) returns cable 7 and paddle 6 to the beginning position so that the handle will be ready when the user returns to stroke again with the first hand. The details of the hydraulic resistance and the sliding torso support/rocker 22 are explained below.

The frame 29 is sized so that the user's fingers do not touch the ground or the base 20 during the full extension of a normal stroke. It is also possible to provide an adjustable mechanism for frame elements 29 and 28, to accommodate users of significantly different heights.

Because the rear support frame 29 is essentially cantilevered from the base 20, it must be of sufficiently stiff material to support high torque around the rear, and also high bending stresses throughout its length. Suitable material includes 3" web steel channel, round tubing of 2.5" diameter, as well as many other structural shapes. The heavy gauge tubing also minimizes vibration.

When a swimmer practices strokes that feature the alternate use of one arm followed by the other, such as the free-style or back-stroke (as opposed to strokes that feature the simultaneous symmetric motion of both arms, such as the breast stroke or butterfly), the swimmer's body rolls in the water, first to one side, then to the other, and then back again. This rolling, or rocking motion, is satisfactorily simulated by sliding the torso support/rocker 22 along a curved track, which is convex to the ground. The means by which the torso support/rocker 22 is enabled to slide along a curved track is shown schematically with further reference to FIG. 2 and FIG. 3.

Typically in a freestyle stroke the user's hand follows a path generally indicated by the outline of the hemisphere HS. The return stroke also follows this path in reverse, rather than a standard, over-the-head recovery. This is because, as is explained below, on the recovery stroke, there is a spring force applied to the paddles 6 to return them to the rest position. If the hand were recovered over the head, as in swimming, the force applied by the elastic return mechanism, would cause discomfort. It is easier to return the paddles to their starting position by following this path. Additionally, the intent of the machine is to develop the muscles used during the catch portion of the stroke so there is no point in using an overhead hand recovery.

Figure 2:
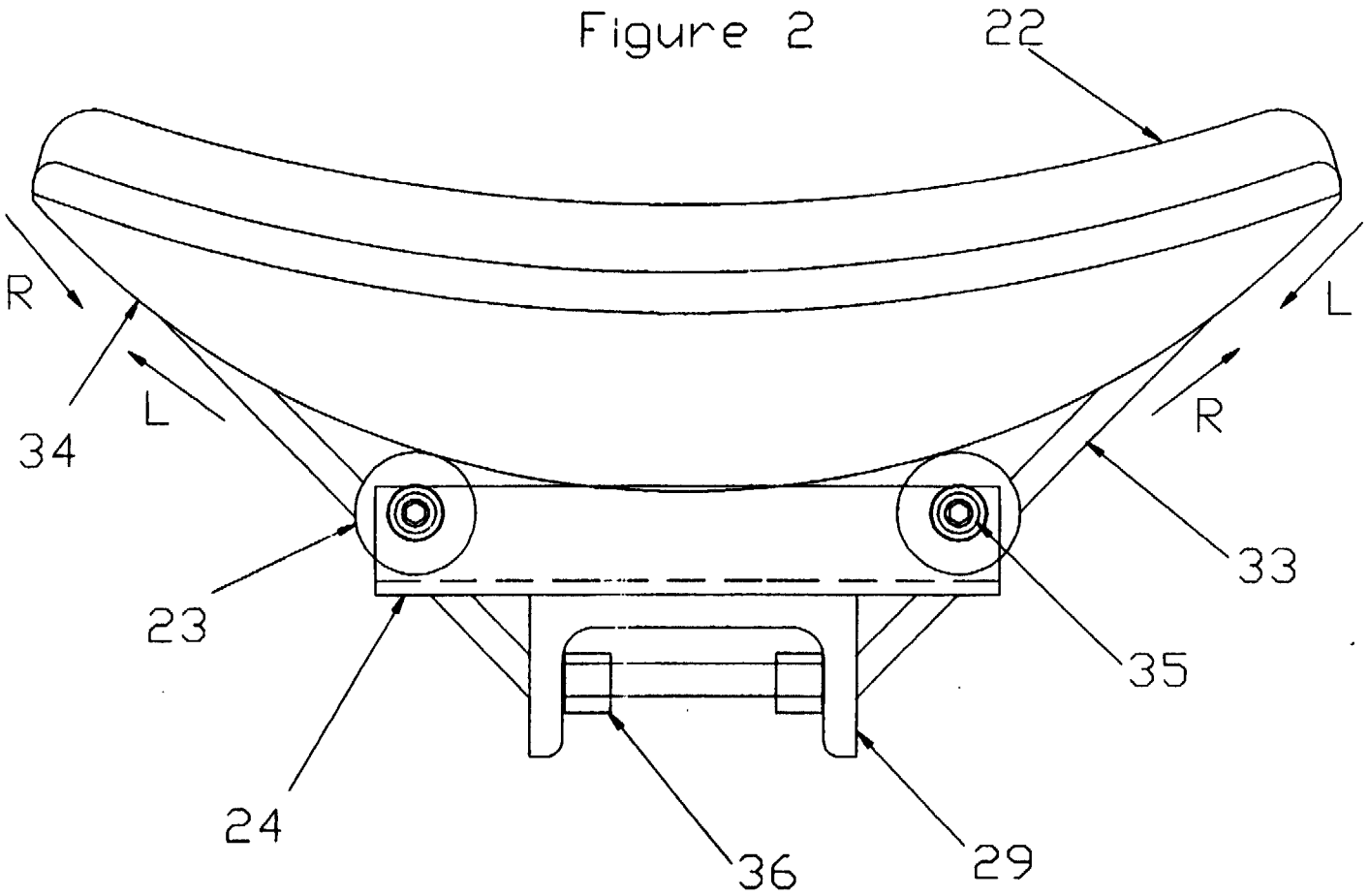
FIG. 2 is a schematic front elevation view of the front edge of the torso support and supporting undercarriage.
Figure 3:
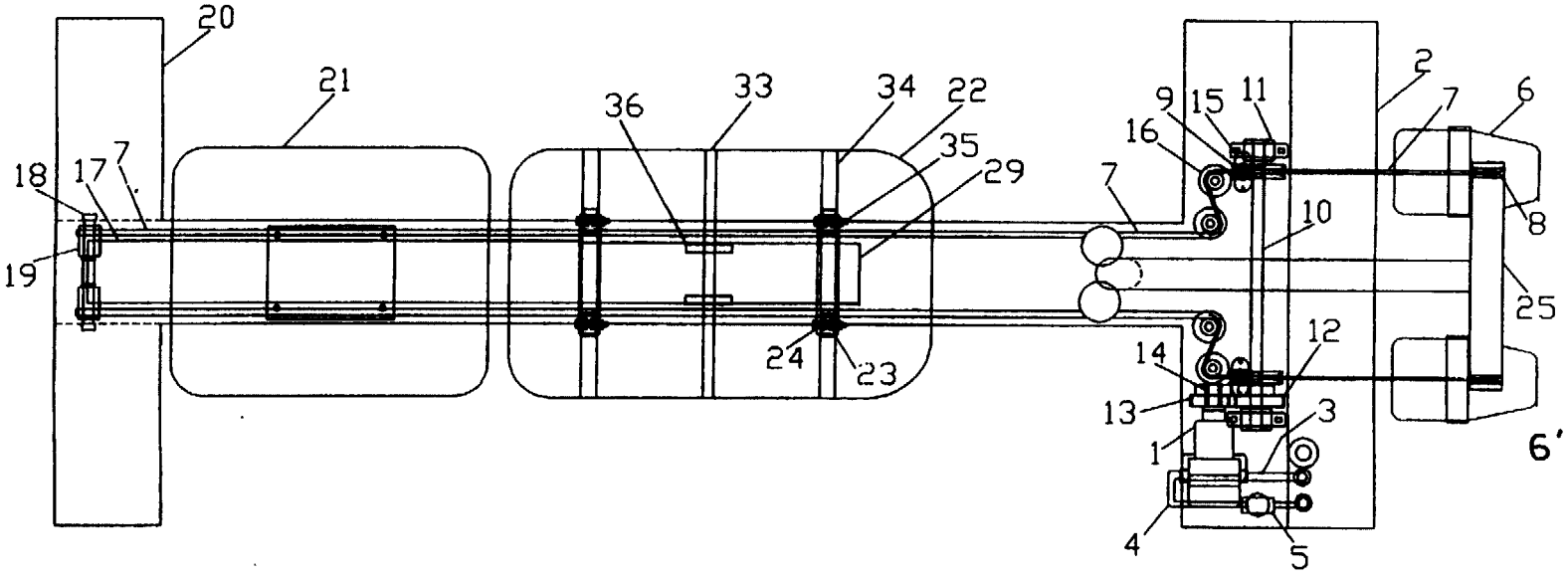
FIG. 3 is a schematic top plan view of the apparatus of the present invention with all hidden parts shown.
Figure 4:
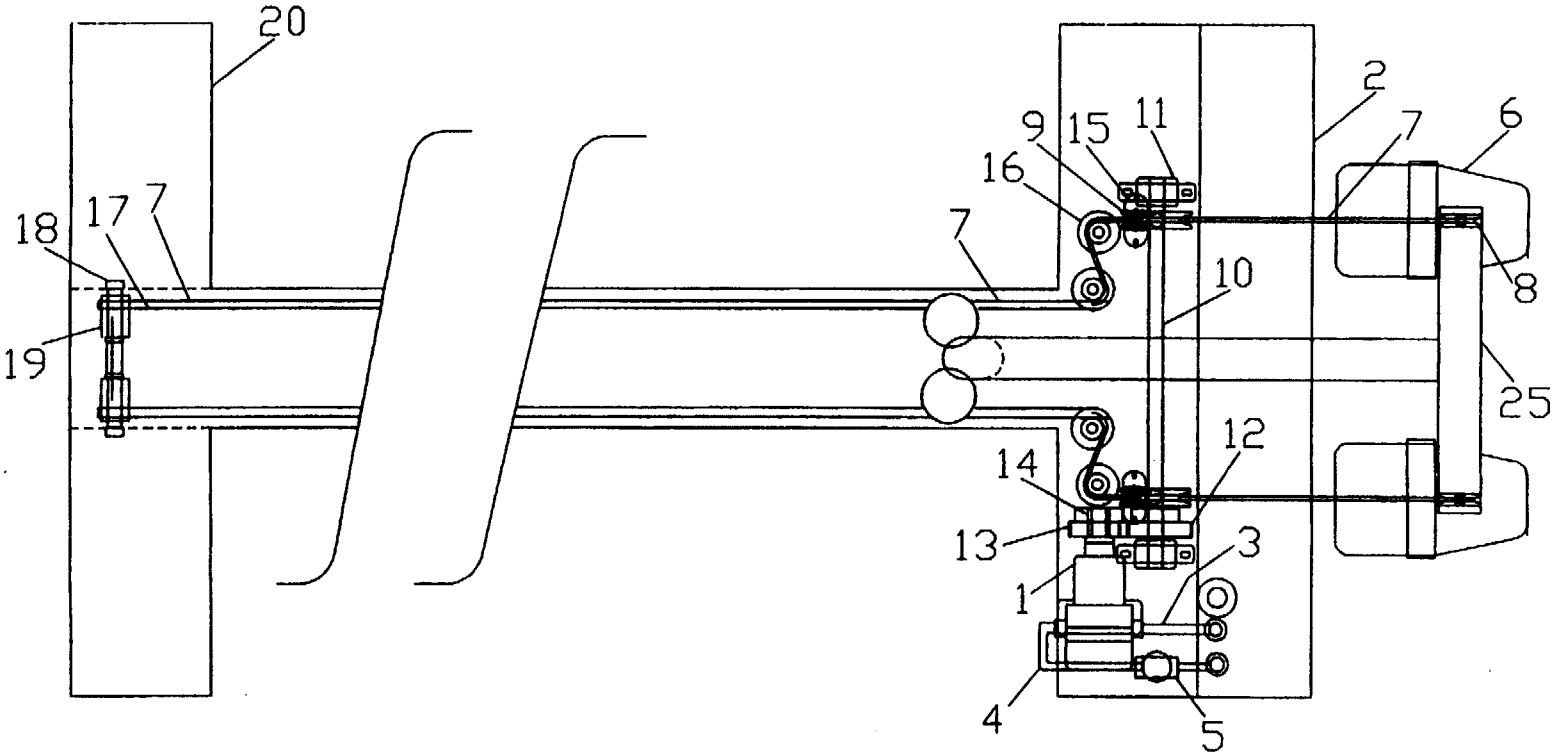
FIG. 4 is a schematic top plan view of the resistance mechanism of a preferred embodiment of the present invention.
Figure 5:
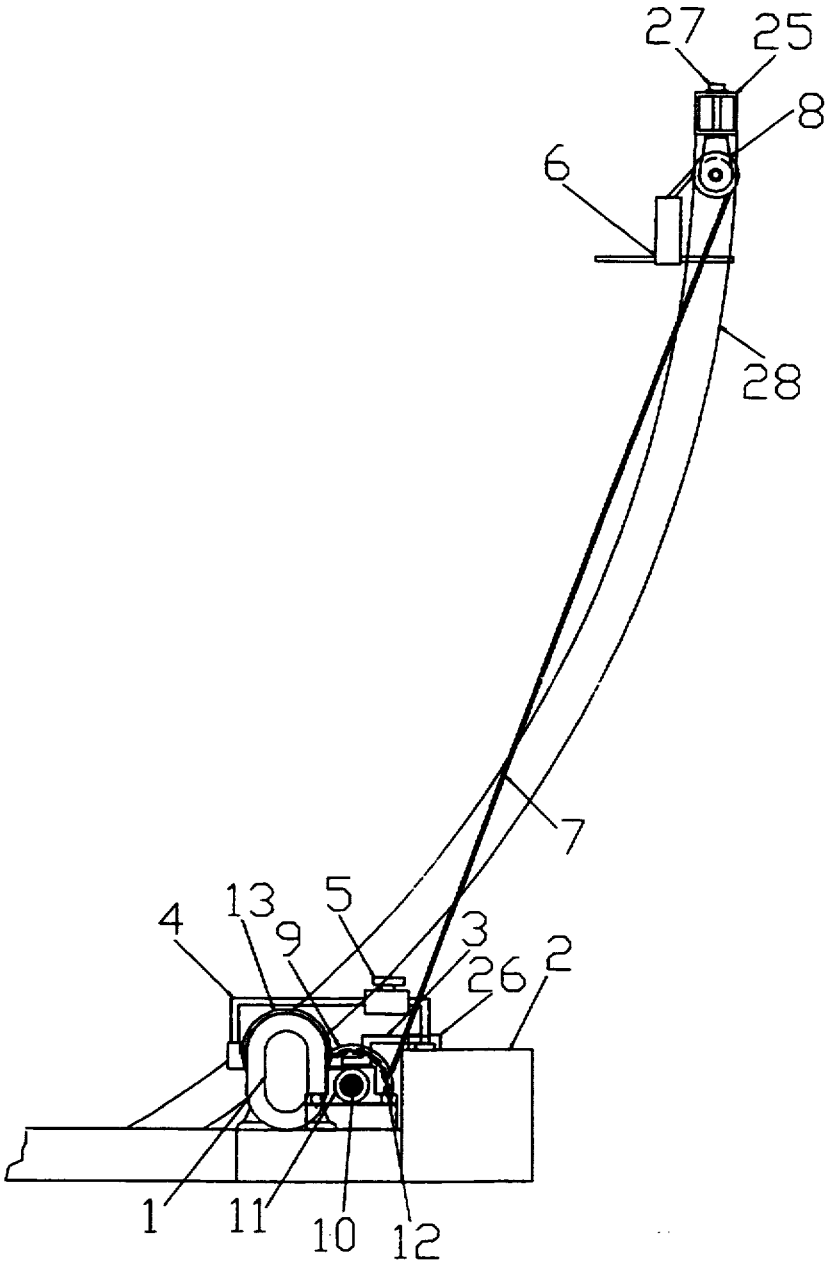
FIG. 5 is a side view of the resistance mechanism of a preferred embodiment of the present invention and return mechanism.
Figure 6A:
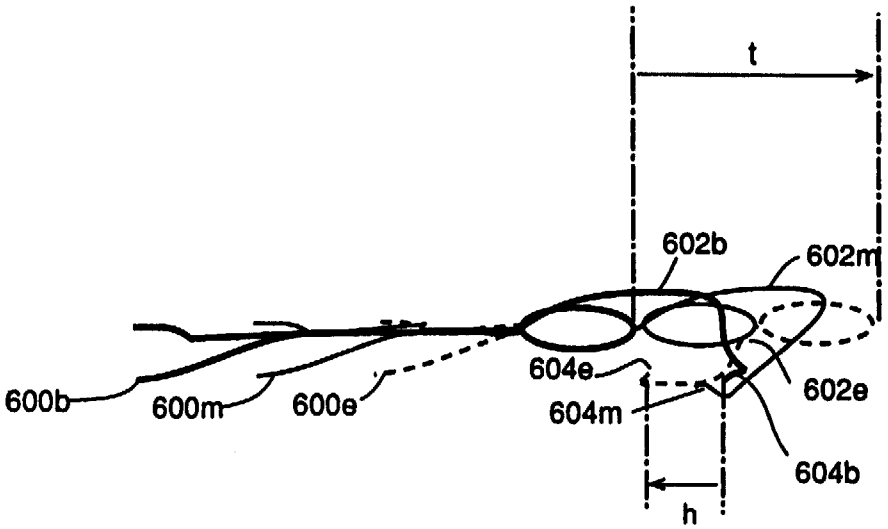
Figure 6B:
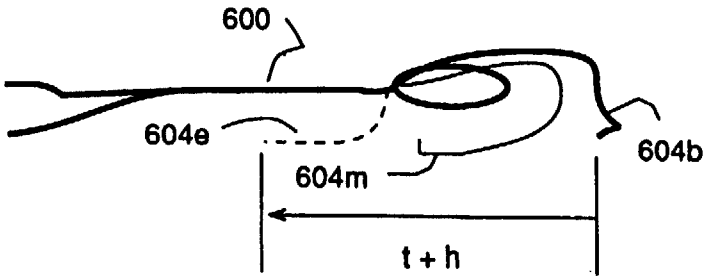

The torso support/rocker 22 is made from a single piece of formed plastic. There is an additional layer of foam padding which is secured to the top of the torso support/rocker 22. This torso support/rocker must be firm and durable enough to support the user's weight over many hours of use, and also soft enough so that the user is comfortable resting upon it. The torso support-/rocker is formed with a curved top to cradle the user's chest. It has been found that a curved surface provides suitable comfort. From the top surface two crescent shaped pieces 34 extend below, each has a rolling surface on its bottom that is shaped according to the desired curve of motion. The crescent support pieces 34 are shaped so that their axis of rotation runs approximately even with the user's spine. Each has a radius of curvature of 8 inches. The axis of rotation is depicted in FIG. 2.

The crescent shaped support pieces 34 rest upon a pair of rollers 23, which can be made of polyurethane, wood, metal, or other suitable material. Polyurethane provides silent and smooth rolling. These rollers 23 are supported by rear frame 29 through roller mount 24. The rollers 23 are free to spin on axles 35. As is shown in FIG. 1, a set of rollers 23, crescent shaped support pieces 34, etc., is provided at both the forward and rearward edges of torso support/rocker 22, separated by about one foot. As the user tips his/her body naturally due to the motion of one arm or the other, the body tends to roll down on the side on which the arm is moving forward and downward. Because the torso support is free to slide on its crescent support pieces 34 along rollers 23, it does so, allowing the body to roll naturally down toward the center of the torso support-/rocker 22.

For instance, if the user simulates a free-style stroke, (also known as the "crawl") lying on his/her chest, and casts his/her right arm forward and downward into the space that would be below the water's surface, the torso support slides in the direction indicated by the arrows R in FIG. 2 (looking at the torso support/rocker 22 from the direction of the user's head). For the opposite, left-armed stroke, the torso support slides in the direction indicated by the arrows L. In a preferred embodiment, the axis of rotation of the bench is approximately five inches above the upper surface of the torso support-/rockers' foam padding, which is approximately the location of the user's head and spine. Thus, as in swimming, the user's head does not move up and down during use, only the torso rotates.

In a preferred embodiment, the torso support/rocker 22 remains stationary with respect to the forward and rearward directions of the frame. Thus, it is necessary to prevent the bench from moving forward, despite the forces applied by the user through the paddles 6. The torso support is held down to the base by a resilient band 33 which is attached to the center edges of the torso support/rocker 22. It runs through two holes on opposite sides of the rear frame support 29 where it is secured with tubing clamps 36. The resilient band serves to hold the torso support/rocker onto the rollers 23. The crescent shaped support pieces 34 lie partially in the roller mount channel 24. This keeps the torso support/rocker 22 from moving forward when pressure is applied to the paddles 6.

The bench should return to a neutral position almost effortlessly. In order to assist the rolling of the body back to the neutral position between strokes, the resilient band 33 discussed above stretches on one side when the body is rolled downward during the catch portion of a stroke. When the body is rolled back to the neutral position the band 33 assists to pull the body back to the neutral position. The band or bands 33 may be rubber tubing or other elastic media.

A feature that contributes significantly to the authenticity of the feel of a swim bench is the dynamic response of the resistance mechanism.

A hydraulic resistance apparatus simulates these aspects of the resistance actually experienced in swimming, and is used in a preferred embodiment of the invention. As previously mentioned a fluid displacement pump 1, an adjustable valve 5, a fluid reservoir 2 and some tubing 3 & 4 are connected as shown in the figures.

As the user pulls on the paddles 6, either of the drive pulleys 9 are rotated and cause the shaft 10 to rotate. The spur gear 12 also rotates with the shaft. The spur gear 12 causes the spur gear 13 to rotate. There is a one-way clutch 14 between the gear 13 and the pump shaft. The one-way clutch will transmit power from the gear 13 to the pump shaft when the paddles 6 are moved backward towards the hips during the catch portion of a stroke. The one-way clutch 14 will overrun the pump shaft when the paddles are returned to their starting positions during the stroke recovery. The pump 1 will draw fluid from the reservoir 2, through the tube 3 and then force it through the tube 4, adjustable valve 5 and back into the fluid reservoir. By adjusting valve 5, the resistance to turning the pump shaft can be adjusted. Thus, weaker or stronger users can adjust the invention to their needs. It is possible to extend tube 4 and mount the adjustable valve 5 on base 20 or frame 29 so that it is accessible to a user while on the bench. Thus, the user can alter the resistance while using the apparatus.

The relationship between the force required to turn the shaft (through rearward movement of the paddles) and the velocity of the hands and paddles 6 is a force that is proportional to a power of the velocity between two and three. The inventor believes that the force applied to move water through the tubing 3 & 4 and the adjustable valve 5 is proportional to a cube of the velocity of the paddles or the angular velocity of the pump shaft and rotor. See generally, R. Fox and A. McDonald, *Introduction to Fluid Mechanics*, John Wiley & Sons, Inc., New York, pp. 336–370 (1973), which is incorporated herein by reference. The force versus hand paddle 6 velocity relationship of the hydraulic resistance mechanism makes the swimming machine "feel" like swimming. Thus, the dynamics of the hydraulic resistance system faithfully simulate the dynamics of swimming. Thus, the present invention permits motion of the swimmer's muscles through a path that simulates swimming, and also against a resistance that simulates swimming.

Once the hand and paddle have reached the end of the stroke it is necessary to return the paddles and cables to their starting position. One end of each cable is secured to a long (~60 inches) piece of resilient tubing 17. The tubing is routed around a pair of rollers 19 which rotate on shafts 18. The tubing runs parallel to the cables 7 and is secured to the underside of the base 20 near the front of the machine. The tubing stretches when the paddles 6 are moved backward during a stroke. The stretched tubing pulls on the cables 7 and paddles 6 during the arm recovery after each stroke.

In a preferred embodiment, the pump moves 4 GPM at a rotary speed of 1725 rpm. During normal operation between 1 and 3 gallons of fluid per minute will be moved through the pump, tubing and adjustable valve. Various sizes of tubing, valves and pumps can be used to provide the correct "feel" or resistance. A preferred embodiment uses ⅜" diameter tubing and a ⅜" adjustable needle valve. As has been mentioned, 1.0 cm diameter surgical tubing is adequate to return the paddles during stroke recovery. Any elastic member that returns the paddles 6 during the time the user recovers the stroke position is adequate.

The foregoing discussion should be understood as illustrative and should not be considered to be limiting in any sense. While this invention has been particularly shown and described with references to preferred embodiments thereof, it will be understood by those skilled in the art that various changes in form and details may be made therein without departing from the spirit and scope of the invention as defined by the claims.

Any device that provides a frame that is supported wholly from the rear by a cantilevered frame so that the user's hands are free to pass beneath his/her hip and waist area during a stroke is within the scope of the present invention.

Any device that provides a rolling motion of the torso with an axis of rotation located between 4 and 7 inches above the top surface of the torso support, and which keeps the hips stationary in a horizontal position, and which cradles the chest in a padded curved cradle is in the contemplation of the invention.

Any resistance device which uses a rotary driven fluid displacement device with an adjustable valve as the primary means of resistance to backward movement of the hand paddles and cables is in the contemplation of the invention. This includes the resistance mechanism shown in the figures. The sizes of the pulleys, gears, tubing, valve and pump may be altered and still be in the contemplation of the invention.

If the device is to be used for simulating the conditions of a backstroke, the shape of the bench surface may be altered slightly to more comfortably support the user's back. Further, the radius of curvature of surface 38 may be altered slightly, providing for a larger radius, because the rolling in practicing the back stroke is most appropriately simulated by rolling around the surface of a circle larger than that appropriate for a crawl stroke. The rocking motion of the bench is still maintained, however, in the backstroke.

Having described the invention, what is claimed is:

1. An exercising apparatus comprising:

a) a base support member with first and second ends and a longitudinal axis;

b) a cantilevered support frame having a lower end fixed to said first end of said base support member and a free end;

c) a first stationary body support fixed in a horizontal position relative to said support frame and above said support frame and having a rear end spaced inwardly from said fixed end of said support frame;

d) an inclined second body support having an upper surface that conforms to the shape of a torso of a trainee, said second body support being independent of said first body support and mounted on said support frame for limited rotation about said support frame and having an axis of rotation that is above the upper surface of said second body support;

e) hand grasping means associated with said exercising apparatus; and f) fluidic resistance means cooperating with said hand grasping means, said fluidic resistance means providing for an adjustable high resistance cycle and a low resistance cycle for said hand grasping means.

2. An exercising apparatus according to claim 1, wherein said hand grasping means includes individual paddles and said fluidic resistance means includes a rotary driven fluid displacement pump connected to a fluid filled reservoir.

3. An exercising apparatus according to claim 2, wherein said fluidic resistance means includes an adjustable valve between a pump outlet and said reservoir so that resistance to the fluid displacement can be adjusted.

4. An exercising apparatus according to claim 2, wherein said fluidic resistance means includes means for deactivating said pump to provide for said low resistance cycle, such that the pump is deactivated when said means for grasping are brought from a position behind a trainee's hips forward to a resting position at said second end.

5. An exercising apparatus according to claim 1, wherein said second body support has an axis of rotation located between about 4 to about 7 inches above the upper surface of said second body support.

6. An exercising apparatus according to claim 1, wherein said second body support is inclined at an angle of between about 5° to about 10°.

7. A waterless swim training apparatus comprising:

a) a longitudinally extending base support member with a longitudinal axis;

b) a cantilevered support frame having a lower end fixed to a first end of said base support member and an upward and longitudinally extending free end;

c) a first body support having an upper surface to receive the hip portion of a trainee, said first body support being fixed in a horizontal position relative to said support frame and extending upwardly therefrom, said first body support having a rear end spaced inwardly from said fixed end of said support frame and said first end of said support member;

d) a second body support having an upper surface that is substantially concave and conforms to the shape of a torso of a trainee, said second body support being separate and longitudinally spaced from said first body support and being closer to said free end of said support frame, said second body support being mounted on said support frame for limited rotation about said support frame and having an axis of rotation that is above the upper surface of said second body support, said second support being inclined upwardly relative to a plane defined by said first body support and said base support member;

e) hand grasping means associated with training apparatus and connected thereto adjacent a second end of said base support member; and f) fluidic resistance means cooperating with said hand grasping means, said fluidic resistance means providing for an adjustable high resistance cycle and a low resistance cycle for said hand grasping means.

8. A waterless swim training apparatus according to claim 7, wherein said hand grasping means includes individual paddles and said fluidic resistance means includes a rotary driven fluid displacement pump connected to a fluid filled reservoir.

9. A waterless swim training apparatus according to claim 8, wherein said fluidic resistance means includes an adjustable valve between a pump outlet and said reservoir so that resistance to the fluid displacement can be adjusted.

10. A waterless swim training apparatus according to claim 9, wherein said fluidic resistance means including means for deactivating said pump to provide for said low resistance cycle, such that the pump is deactivated when said means for grasping are brought from a position behind a trainee's hips forward to a resting position at said second end of said swim training apparatus.

11. A waterless swim training apparatus according to claim 7, wherein said cantilevered support frame is inclined upwardly towards said free end to provide the angle of inclination for said second body support.

12. A waterless swim training apparatus according to claim 7, wherein said first body support member has an upper surface that is substantially horizontally disposed.

13. A waterless swim training apparatus according to claim 7, wherein has a lower surface that is convex and rests upon a pair of parallel rollers positioned on respective sides of said support frame to provide said limited rotational movement thereabout and includes resistance means to aid in returning the trainee to an initial starting position.

14. A waterless swim training apparatus according to claim 7, wherein said fluidic resistance means provides resistance against the motion of the means for grasping according to a relationship where the force of resistance is substantially proportional to a power P of the velocity of the means for grasping over a velocity range of between three and seven feet per second.

15. A waterless swim training apparatus according to claim 7, wherein the fluidic resistance means includes a piston in a fluid filled cylinder.

16. A waterless swim training apparatus according to claim 7, wherein said second body support has an axis of rotation located between about 4 to about 7 inches above the upper surface of said second body support.

17. A waterless swim training apparatus according to claim 7, wherein said second body support is inclined at an angle of between about 5° to about 10°.

18. A training apparatus comprising, a) a trainee support member;

b) a base support connected to said trainee support member therefor; and c) a hand resistance system, said hand resistance system including engaging means for the trainee's hands and a hydraulic fluid resistance unit, said hydraulic fluid resistance unit including, 1) a reservoir means containing a hydraulic fluid, 2) a displacement pump, 3) an adjustable valve in fluid communication with and located between said displacement pump and said reservoir means to provide adjustable fluid resistance;

d) linkage means connecting said engaging means and said displacement pump such that the displacement pump will rotate during movement of a trainee's hands and arms in a first direction and disengage when the hands or arms are returned to starting position.

* * * * *